United States Patent [19]

Magee

[11] Patent Number: 5,073,843

[45] Date of Patent: Dec. 17, 1991

[54] PHOSPHORESCENT KEY PAD

[76] Inventor: Vera C. Magee, 5165 Iroquois, Detroit, Mich. 48213

[21] Appl. No.: 606,556

[22] Filed: Oct. 31, 1990

[51] Int. Cl.[5] ..... F21V 9/16

[52] U.S. Cl. ..... 362/84; 362/24; 362/85; 362/109; 40/542; 40/337; 250/465.1

[58] Field of Search ..... 362/24, 23, 84, 85, 362/109; 250/462.1, 463.1, 465.1, 466.1; 40/337, 542

[56] References Cited

U.S. PATENT DOCUMENTS

| | | | |
|---|---|---|---|
| 1,246,080 | 11/1917 | Frank | 250/465.1 |
| 2,382,806 | 8/1945 | Motson | 40/542 X |
| 3,197,573 | 7/1965 | Anson | 40/337 X |
| 4,124,879 | 11/1978 | Schoemer | 362/26 |
| 4,247,747 | 1/1981 | Swattan | 200/314 |
| 4,255,622 | 3/1981 | Reed | 40/337 |
| 4,343,975 | 8/1982 | Sado | 200/314 |
| 4,449,024 | 5/1984 | Stracener | 200/317 |
| 4,893,222 | 1/1990 | Mintzer | 362/109 |
| 4,905,127 | 2/1990 | Kaminski | 362/109 |
| 4,949,230 | 8/1990 | Burmeister | 362/109 |

OTHER PUBLICATIONS

Lterature of Palmer Paint Products, Inc., Troy, MI "Creative Touch" circa 1990.

Shannon Luminous Materials, Inc., of Santa Ana, CA, Advertisement on p. 7430 of 1987 Thomas Register.

*Primary Examiner*—Stephen F. Husar

*Attorney, Agent, or Firm*—Peter D. Keefe

[57] ABSTRACT

A key pad having phosphorescent portions which provide the user with the ability to read the key pad in dark environments, thereby ensuring that the key pad is utilized without error. Information indicia on the key pad, or areas immediately adjacent thereto, are provided with phosphorescence. The key pad may be manufactured with this property, or phosphorescent informational indicia may be sold in kit form to be selectively applied via an adhesive to a conventional key pad.

1 Claim, 1 Drawing Sheet

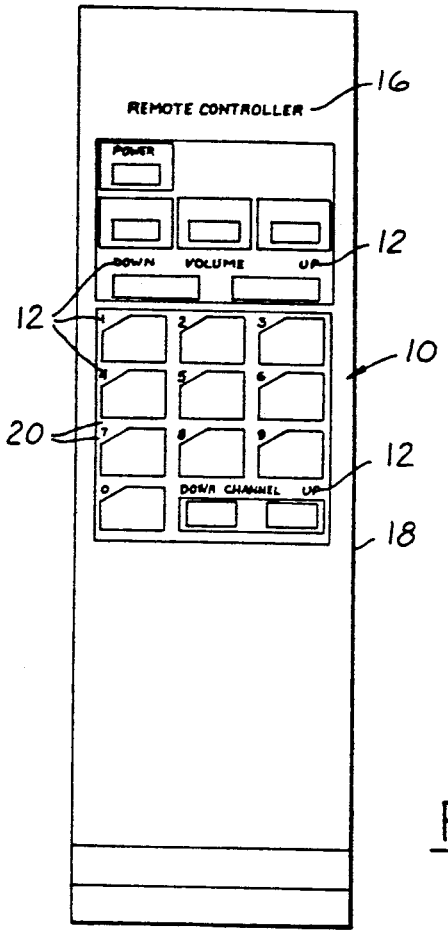
FIG. 1
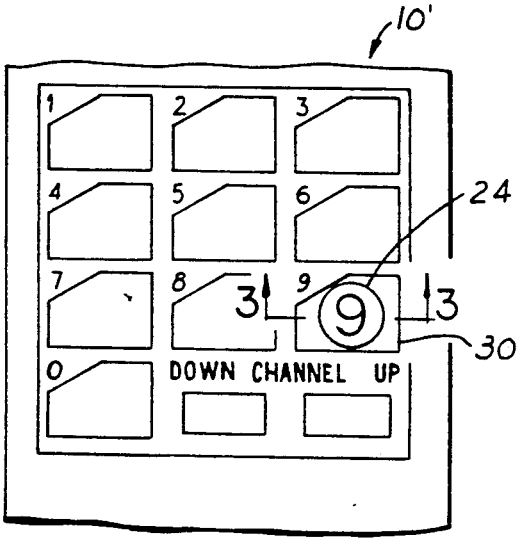
FIG. 2
FIG. 3
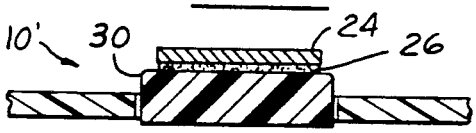
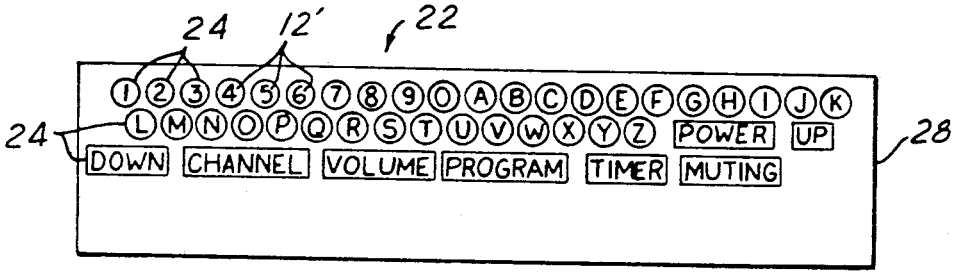
FIG. 4

PHOSPHORESCENT KEY PAD

BACKGROUND OF THE INVENTION

1. Field of the Invention

The present invention relates to key pad devices having some form of illumination for reading the key pad in darkened environments, and more particularly to a key pad having components which exhibit phosphorescence.

2. Description of the Prior Art

Key pads, particularly those used for controlling electronic devices, have come into very wide spread use. Frequently these key pads are used in environments that are dimily lit, or even not lit at all. In such circumstances, the user must use his/her memory to press the appropriate function key. If the use relates to a television or vidocassette recorder and an error pressing keys is made, there is little difficulty beyond perhaps some annoyance. However, if the key pad controls a device that is either dangerous (as for example in an industrial setting) or critical to human life (as for example in a hospital setting) then an accidental mistake at key pressing can result in a calamity. Clearly what is needed is an illumination system for key pads.

In the prior art there are numerous attempts at providing an illumination system for a key pad. One class of such devices is a self-contained illumination system having a battery and light which clips onto the key pad of a remote control. Examples of this first class of devices are U.S. Pat. Nos. 4,949,230 to Burmeister, dated Aug. 14, 1990; 4,905,127 to Kaminski, dated Feb. 27, 1990; and 4,893,222 to Mintzer, dated Jan. 9, 1990. A second class of such devices utilizes a key pad having lighted keys. An example of this second class of devices in U.S. Pat. No. 4,449,024 to Stracener, dated May 15, 1984. A third class of such devices utilizes an optical conductor to transmit illumination from a light source to the keys of the key pad. Examples of this third class of devices are U.S. Pat. Nos. 4,343,975 to Sado, dated Aug. 10, 1982 and 4,247,747 Swatten, dated Jan. 27, 1981.

In each of the prior art illumination devices, some form of illumination source is utilized which requires a power supply, internal or external, to operate. This requirement necessitates bulky and heavy structural configurations and multiple problems associated with electrical power provisions. What is needed is an illumination system for a key pad which requires no power supply connected thereto to operate it.

SUMMARY OF THE INVENTION

The present invention is a key pad having phosphorescent portions which provide the user with the ability to read the key pad in dark environments, thereby ensuring that the key pad is utilized without error.

Informational indicia on the key pad, or areas immediately adjacent thereto, are provided with phosphorescence. The key pad may be manufactured with this property, or phosphorescent informational indicia may be sold in kit form to be selectively applied via an adhesive to a conventional key pad.

Accordingly, it is an object of the present invention to provide a key pad having phosphorescent properties which provides illumination for informational indicia thereon when the key pad is used in dark environments.

It is a further object of the present invention to provide a kit having phosphorescent informational indicia which may be selectively applied to a conventional key pad utilizing an adhesive in order that the keys of the key pad may be distinguished in dark environments.

These, and additional objects, advantages, features and benefits of the present invention will become apparent from the following specification.

BRIEF DESCRIPTION OF THE DRAWINGS

FIG. 1 is a plan view of a remote control having a key pad according to the present invention.

FIG. 2 is a detail view of a key pad which has been modified according to the present invention.

FIG. 3 is a sectional view along lines 3—3 in FIG. 2, showing a key of a conventional key pad modified according to the present invention.

FIG. 4 is a kit according to the present invention for modifying a conventional key pad.

DETAILED DESCRIPTION OF THE PREFERRED EMBODIMENT

Referring now to the Drawing, FIG. 1 shows a key pad 10 in which selected informational indicia 12 have an associated phosphorescent property which permits the selected informational indicia to be read in dark environments. It is preferred that the selected informational indicia 12 be those which define functionality of adjacent keys 14 of the key pad 10, rather than those 16 which are of general information only. The key pad 10 is shown in FIG. 1 as part of a remote control unit 18. It is to be understood that the key pad 10 can be used in devices other than remote controls.

Phosphorescent materials are notoriously well known in the prior art, and it is preferred to utilize a conventional phosphorescent plastic or coating in the construction of the key pad 10. Usable phosphorescent materials are manufactured, for example, by Shanon Luminous Materials, Inc. Of Santa Ana, Calif. It is preferred that the association between the phosphorescent property of the key pad and the selected informational indicia 12 be either in the form of the selected informational indicia itself having the phosphorescent property or, alternatively, the area 20 immediately surrounding the selected informational indicia having the phosphorescent property. In the latter case, the selected informational indicia 12 may be translucent and applied over the phosphorescent area 20 of the key pad 10, or , alternatively, the selected informational indicia 12 may be opaque and applied over the phosphorescent area 20 of the key pad 10.

In operation, the key pad is exposed to light during which the phosphorescence is charged. Thereafter, the selected informational indicia 12 is clearly distinguished in a darkened environment by the associated phosphorescence of the key pad, or alternatively, by the phosphorescence of the selected informational indicia, itself.

Additionally, phosphorescent informational indicia 12' may be selectively applied to an existing conventional key pad 10' utilizing a kit 22, as shown generally in FIG. 4. The kit 22 contains an assortment of informational indicia units 24 that contain informational indicia 12' specific to the intended use of the key pad 10'. The example shown in FIG. 4 is for a key pad used in connection with a videotape recorder remote control.

It is preferred that the informational indicia units 24 be composed of a thin, flexible phosphorescent material having an adhesive backing 26 on one side and informational indicia 12' on the other side. The adhesive backing 26 is then applied to an adhesively releasable backing material 28 in a well known manner. The thickness of the informational indicia units 24 is sufficient to provide a desired amount of phosphorescent activity for a desired length of time based upon probable light exposure during those periods of illumination which are expected to charge the phosphorescence.

In operation of the kit 22, selected ones of the informational indicia units 24 are peeled from the backing material 28 and then placed at selected locations on the key pad 10'. The selected locations may be either the keys 30 which correspond to the respective information contained in the informational indicia 12' on the informational indicia unit 24, or a location adjacent thereto. As shown in FIGS. 2 and 3, a key 30 is covered by an informational indicia unit 24; in this example, the key 30 "9" is covered by an informational indicia unit 24 having marked thereon the informational indicia 12' indicative of the numeral "9".

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A key pad illumination kit for a key pad, the key pad comprising a plurality of keys for being selectively pressed by a user, each key of the key pad having informational indicia for indicating to the user functionality information of that respective key of said plurality of keys, said key pad illumination kit comprising:

a backing material;

a plurality of individual informational indicia units, each informational indicia unit of said plurality of informational indicia units having a first side and a second side, said first side of each said informational indicia unit having an indicia thereon corresponding to the informational indicia of a respective key on the key pad, said informational indicia units having a phosphorescent property which illuminates said indicia in darkened environments, said second side of said informational indicia units having an adhesive backing, each second side of said informational indicia unit being releasably attached to said backing material;

wherein a selected informational indicia unit may be removed from said backing material and placed upon the key pad adjacent the respective key thereof in order that the phosphorescence of the informational indicia unit in combination with the indicia thereon informs the user of the function indicia of the respective key in darkened environments of use.

* * * * *